US007258233B2

(12) United States Patent
Lee

(10) Patent No.: US 7,258,233 B2
(45) Date of Patent: Aug. 21, 2007

(54) PACKAGE FOR WIPER BLADE OF VEHICLE

(75) Inventor: Byoung-Young Lee, Seoul (KR)

(73) Assignee: Hyundai Mobis Co., Ltd., Yongin-shi (KR)

( * ) Notice: Subject to any disclaimer, the term of this patent is extended or adjusted under 35 U.S.C. 154(b) by 342 days.

(21) Appl. No.: 10/725,490

(22) Filed: Dec. 3, 2003

(65) Prior Publication Data

US 2005/0082185 A1 Apr. 21, 2005

(30) Foreign Application Priority Data

Oct. 16, 2003 (KR) ..... 10-2003-0072076

(51) Int. Cl.
*B65D 73/00* (2006.01)
*B65D 5/00* (2006.01)
*B65D 51/18* (2006.01)

(52) U.S. Cl. ..... 206/470; 206/766; 220/254.3; 220/254.7

(58) Field of Classification Search ..... 206/461–471, 206/495, 335, 1.5, 766, 45.23, 736, 774, 206/775, 776; 220/254.1, 254.3, 254.7, 826, 220/831–833, 315, 834
See application file for complete search history.

(56) References Cited

U.S. PATENT DOCUMENTS 3,417,897 A * 12/1968 Johnson ..... 220/254.3
4,499,353 A 2/1985 Shields
5,147,035 A * 9/1992 Hartman ..... 206/45.23
D368,027 S * 3/1996 Baker ..... D9/415
D368,028 S * 3/1996 Baker ..... D9/415
D368,029 S * 3/1996 Baker ..... D9/415
5,570,856 A * 11/1996 Sharpe ..... 242/588.3
5,899,334 A 5/1999 Domerchie et al.
6,070,723 A * 6/2000 Lewis ..... 206/335
6,247,590 B1 * 6/2001 Baker ..... 206/335
6,279,746 B1 * 8/2001 Hussaini et al. ..... 206/470
6,412,637 B1 * 7/2002 Saunders et al. ..... 206/541

FOREIGN PATENT DOCUMENTS

FR 2639909 A * 6/1990

* cited by examiner

*Primary Examiner*—Mickey Yu
*Assistant Examiner*—J. Gregory Pickett
(74) *Attorney, Agent, or Firm*—Greenblum & Bernstein, P.L.C.

(57) ABSTRACT

This invention relates to a package for packing a wiper blade for a vehicle. The package is constituted of upper and lower cases, in which the upper case is partly opened from and closed again to the lower case. Thus, the package can be conveniently used again.

8 Claims, 3 Drawing Sheets

[FIG. 1]
PRIOR ART
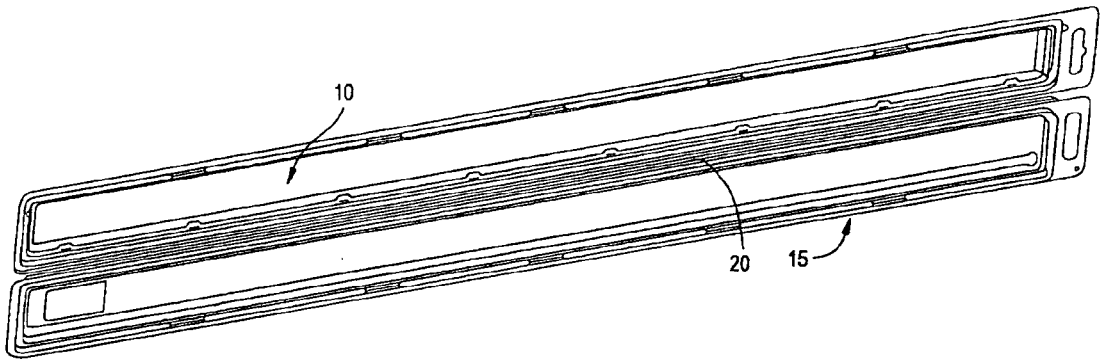
[FIG. 2]
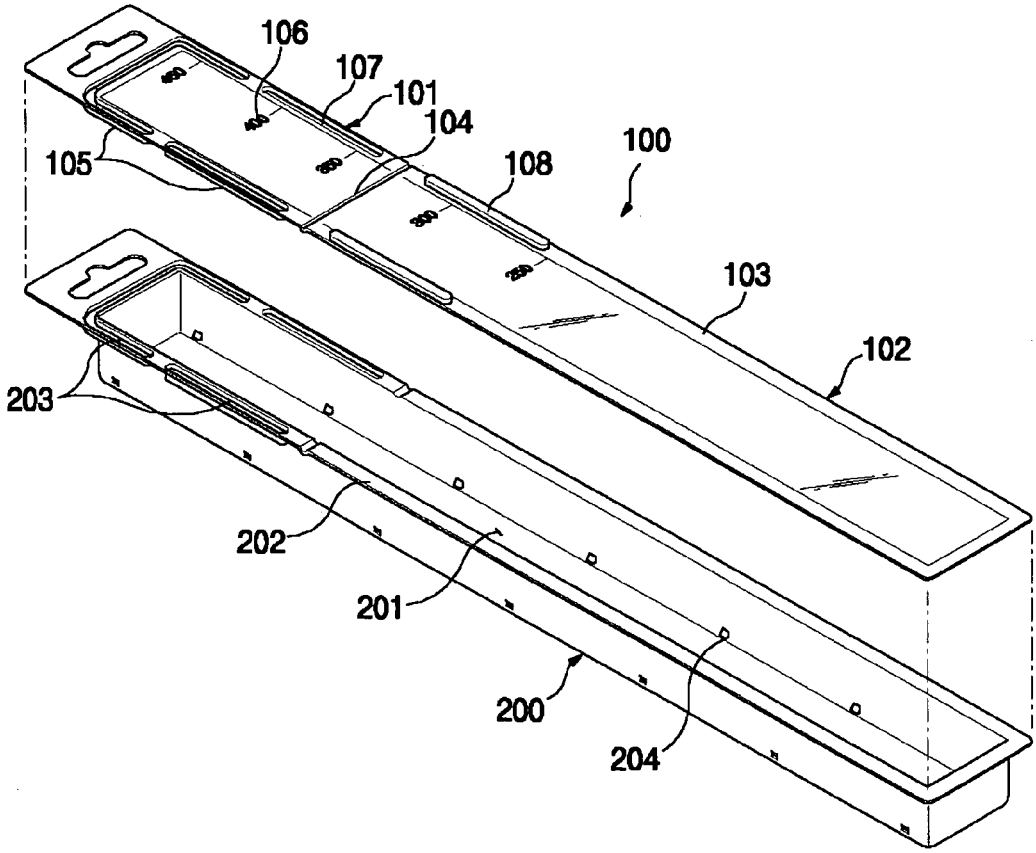

[FIG. 3]
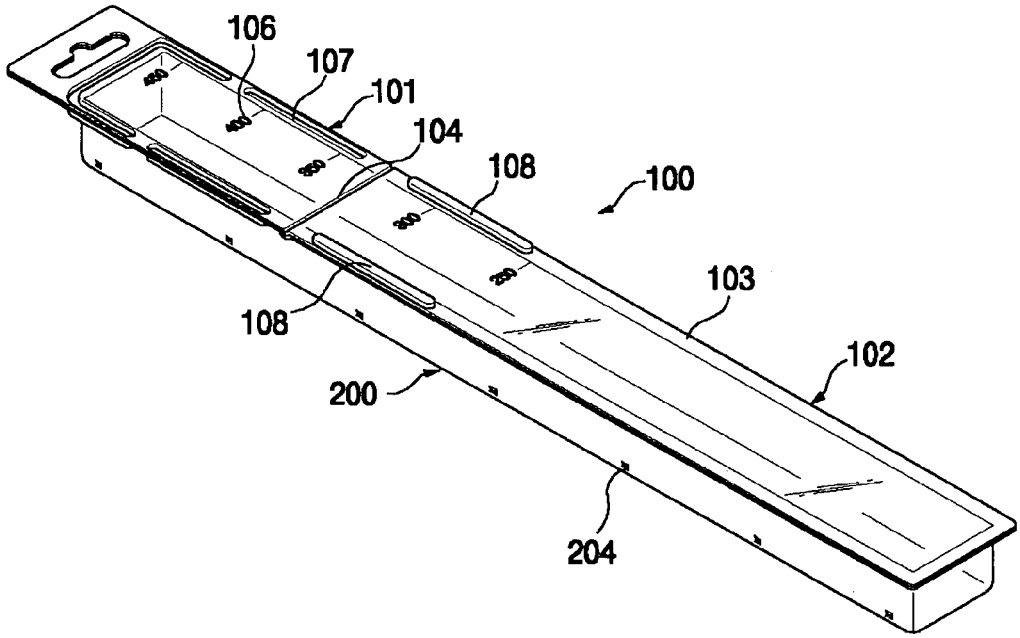
[FIG. 4]
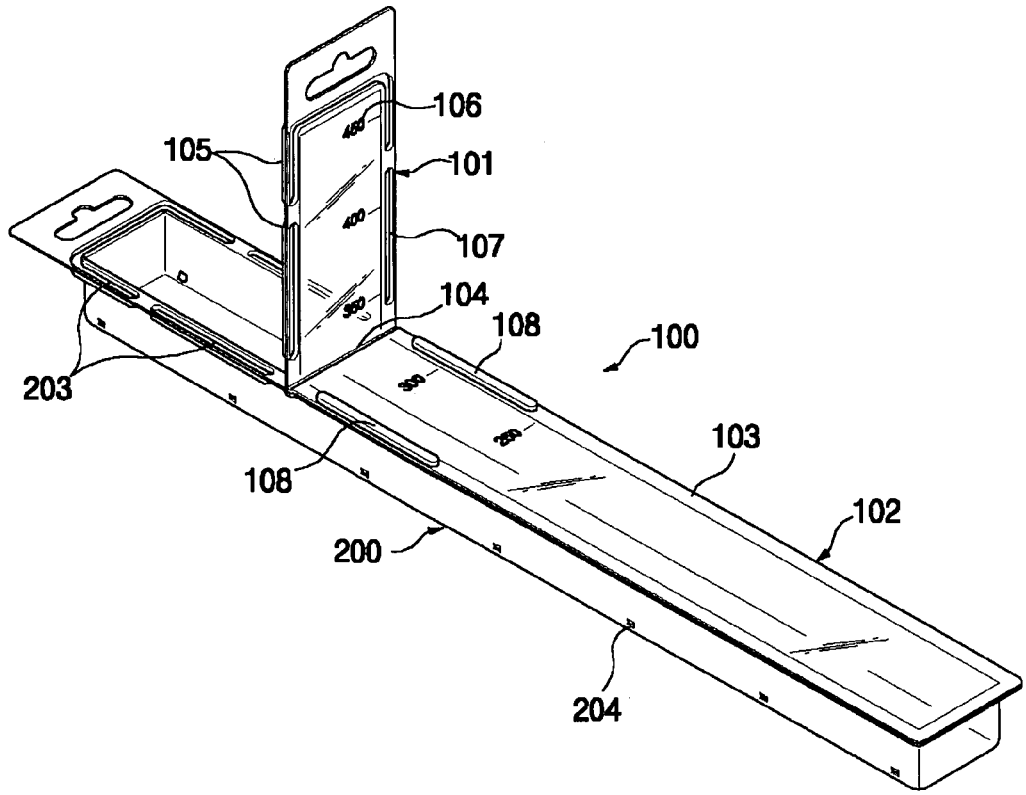

[FIG. 5]
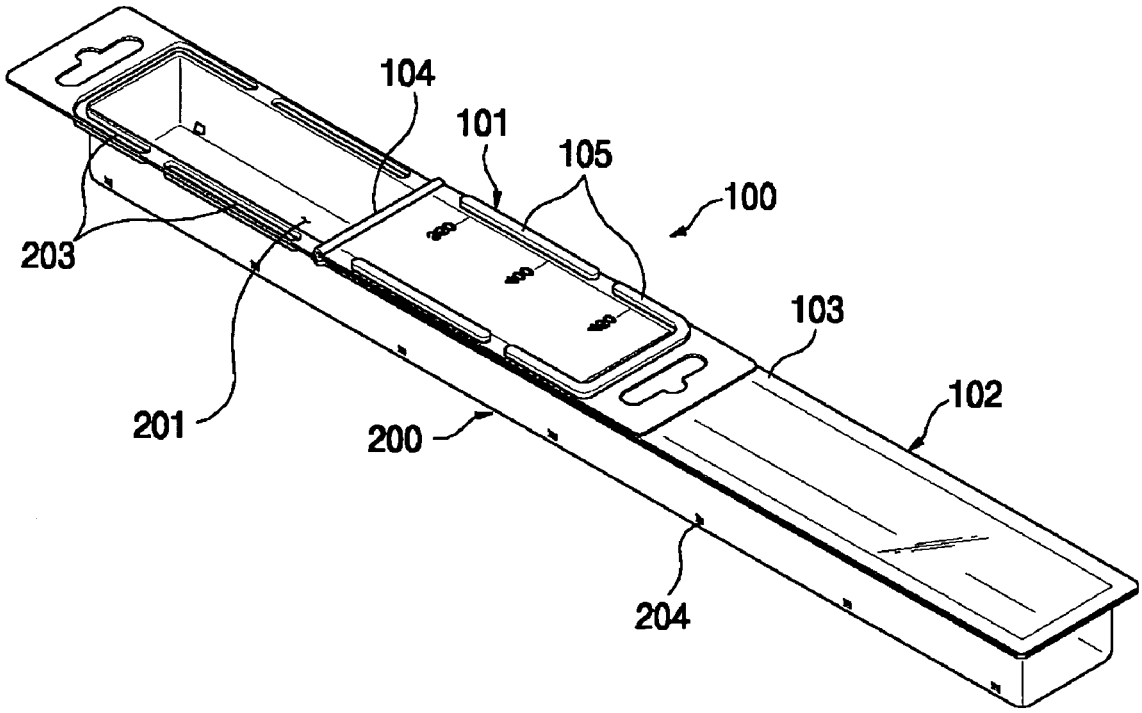

PACKAGE FOR WIPER BLADE OF VEHICLE

RELATED APPLICATIONS

The present disclosure relates to subject matter contained in priority Korean Application No. 10-2003-0072076, filed on Oct. 16, 2003, which is herein expressly incorporated by reference in its entirety.

BACKGROUND OF THE INVENTION

1. Field of the Invention

The present invention relates to a blister pack, particularly to a package for a wiper blade of a vehicle, more particularly to a reusable package for a wiper blade of a vehicle, including upper and lower cases, in which the upper case is partly opened from and closed again to the lower case.

2. Description of the Related Art

Such a package is disclosed in U.S. Pat. No. 5,899,334, for example, as shown in FIG. 1. This package is adapted to be reusable in such a manner that upper and lower cases 10 and 15 are longitudinally coupled with each other throughout their entire lengths by a hinge 20, and are relatively opened and closed each other. In general, most of these packages are designed to open the lower case from the upper case in whole when a wiper blade is packed or unpacked.

As this package, there has been used a blister pack, one example of which is disclosed in U.S. Pat. No. 4,499,353. This blister pack is also adapted to be reusable in a manner that upper and lower cases are longitudinally coupled with each other throughout their entire lengths by a hinge. Similarly to that disclosed in U.S. Pat. No. 5,899,334, the blister pack is designed to open the lower case from the upper case in whole.

SUMMARY OF THE INVENTION

To solve the above-indicated problems, it is, therefore, an object of the present invention to provide a package for a wiper blade of a vehicle, providing reusable capability depending on opening and closing again, as well as convenient usage depending on opening in whole rather than in part.

It is another object of the present invention to provide a package for a wiper blade of a vehicle, capable of providing a more convenient usage by allowing an upper case to be opened and clamped.

To achieve the above object, there is provided a package for a wiper blade of a vehicle, the package comprising an upper case formed of an upper section and a lower section and provided with an upper lip, and a lower case provided with a lower lip and a receiving space, wherein: the upper and lower sections of the upper case are connected with each other by a hinge; the upper lip provided on the lower section of the upper case and the lower lip of the lower case corresponding to the upper lip are clamped each other; the lower lip of the lower case corresponding to the upper lip of the upper section is provided with a first clamped groove; and the upper lip of the upper section is provided with a first clamping projection which can be fitted into the first clamped groove.

Here, the lower case is provided with a receiving space, a bottom of which is provided with at least one specification holding nose for holding a specification of the wiper blade.

Further, the upper case is provided with at least one mark for indicating a size of the wipe bladed received in the receiving space.

Moreover, the upper lip provided on the lower section of the upper case is provided with a second clamping projection which can be fitted into a second clamped groove provided on a front surface of the upper section.

BRIEF DESCRIPTION OF THE DRAWINGS

The above objects, features and advantages of the present invention will become more apparent from the following detailed description when taken in conjunction with the accompanying drawings, in which:

FIG. 1 shows a conventional package is disclosed in U.S. Pat. No. 5,899,334;

FIG. 2 shows according to a preferred embodiment of the present invention;

FIG. 3 shows a state in which both cases are closed each other;

FIG. 4 shows a state in which both cases are opened each other; and

FIG. 5 shows a state in which one case is partly opened and clamped.

DETAILED DESCRIPTION OF THE PREFERRED EMBODIMENT

A preferred embodiment of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

First, FIG. 2 shows a package formed of upper and lower cases 100 and 200 in accordance with a preferred embodiment of the present invention. FIG. 3 shows a state in which both cases are closed each other, while FIG. 4 shows a state in which both cases are opened each other. FIG. 5 shows a state in which an upper section 101 of an upper case 100 is opened, folded back completely and clamped.

As shown in FIG. 2, the upper case 100 is constituted of upper and lower sections 101 and 102, both of which are coupled with each other by a hinge 104. Here, the hinge 104 is preferably an integral hinge, by which the upper and lower sections 101 and 102 are integrally connected with each other.

Both sections 101 and 102 of the upper case 100 are provided with a lip (hereinafter, referred to as an "upper lip"). Particularly, the upper lip 103 of the upper section 101 is provided with a first clamping projection 105, which is embossed toward a rear surface thereof, as shown in FIG. 2.

Thus, a front surface of the upper lip 103 is provided with a second groove (hereinafter, referred to as a "second clamped groove"). The lower section 102 may be provided with a second projection (hereinafter, referred to as a "second clamping projection"), which is embossed toward the front surface the upper lip 103 and corresponds to the second clamped groove 107. An operation between the second clamped groove 107 and the second clamping projection 108 will be described.

The upper case 100 may be provided with at least one mark 106 for indicating a size of the wiper blade in rilievo or intaglio.

As shown in FIG. 2, the lower case 200 is provided a lip (hereinafter, referred to as a "lower lip") as well as a receiving space 210 into which the wiper blade is received. A portion of the lower lip 202, which corresponds to the upper lip 103 of the upper section 101 of the upper case 100, is provided with a first clamped groove 203, into which the first clamping projection 105 can be fitted.

Further, the lower case 200 is provided with at least one specification holding nose 204, as a projection for holding a specification of the wiper blade on the bottom of the received space 201.

These upper and lower cases 100 and 200 are coupled with each other by clamping the upper lip 103, which is formed on the lower section 102 of the upper case 100 is provided, to the lower lip 202 of the lower case 200 corresponding to the upper lip 103.

Here, after the upper case 100 rests on the lower case 200, the first clamping projection 105 of the upper section 101 fits into the first clamped groove 203 of the lower case 200. Thereby, the upper case 100 is closed on the lower case 200. On the contrary, if the first clamping projection 105 of the upper section 101 is released from the first clamped groove 203 of the lower case 200, the upper case 100 is opened from the lower case 200. In this manner, a state in which the upper and lower cases are closed each other is as shown in FIG. 3, while a state in which the upper and lower cases are opened each other is as shown in FIG. 4.

Meanwhile, if the second clamped groove 107 formed on the front surface of the upper lip 103 of the upper section 101 of the upper case 100 is fitted into the second clamping projection 108 formed on the lower section 102 of the upper case 100, the upper section 101 is clamped to the lower section 102 with the upper section 101 folded back completely, as shown in FIG. 5. In this manner, in the case where the upper section 101 is completely folded back and clamped, inference of the upper case 101 is eliminated when the wiper blade is put in or out the receiving space 201. Therefore, it is possible to guarantee convenient usage of the package.

The effects obtained from the package according to the present invention are generally summed up as follows.

First, because the upper case is partly opened, it is difficult for the wiper blade to escape from the receiving space. As a result, it is convenient to use the package. For instance, the package may be hung on a wall with the upper case opened partly.

Second, because the opened upper section of the upper case is completely folded back and clamped to the lower section of the upper case, the opened upper section does not hinder the wiper blade from be put in or out the receiving space. Thus, it is possible to use the package in a more convenient manner.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A package for a wiper blade of a vehicle, the package comprising:

an upper case including an upper section, a lower section and an upper lip extending around the upper section and the lower section; and a lower case including a lower lip and a receiving space configured to receive a wiper blade, wherein:

the upper and lower sections of the upper case are connected with each other by a hinge;

a portion of the upper lip extending around the lower section of the upper case and a first portion of the lower lip of the lower case are configured to be clamped to each other continuously around the lower section;

a second portion of the lower lip of the lower case is provided with a first clamping groove; and a portion of the upper lip extending around the upper section of the upper case is provided with a first clamping projection configured to be fitted into the first clamping groove, wherein the portion of the upper lip extending around the lower section of the upper case is provided with a second clamping projection configured to be fitted into a second clamping groove provided on the portion of the upper lip extending around the upper section of the upper case, and wherein a protruding portion of the upper lip extending around the upper section of the upper case forms the first clamping projection on one side thereof and the opposite side thereof forms the second clamping groove.

2. The package as claimed in claim 1, wherein the receiving space of the lower case includes at least one specification holding nose that holds a specification of the wiper blade.

3. The package as claimed in claim 1, wherein the upper case is provided with at least one mark that indicates a size.

4. The package as claimed in claim 2, wherein the upper case is provided with at least one mark that indicates a size.

5. The package as claimed in claim 1, wherein the receiving space of the lower case contains a wiper blade.

6. The package as claimed in claim 2, wherein the receiving space of the lower case contains a wiper blade.

7. The package as claimed in claim 1, wherein the upper case is configured such that the second clamping projection is fitted into the second clamping groove when the upper section is rotated around the hinge so that the upper section overlies and is adjacent to the lower section.

8. The package as claimed in claim 1, wherein the first clamping projection is provided on the portion of the upper lip extending around the upper section of the upper case.

* * * * *